US006265331B1

(12) United States Patent
Steiner

(10) Patent No.: US 6,265,331 B1
(45) Date of Patent: Jul. 24, 2001

(54) WIRE-SCREENING FABRIC, METHODS OF USING THE SAME, AND PAPERMAKING MACHINES COMPRISING SUCH FABRICS

(75) Inventor: Karl Steiner, Herbrechtingen (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/292,978

(22) Filed: Apr. 16, 1999

(30) Foreign Application Priority Data

Apr. 17, 1998 (DE) ..... 198 17 050

(51) Int. Cl.[7] ..... D02G 3/00

(52) U.S. Cl. ..... 442/195; 442/196; 428/397; 162/900; 162/902

(58) Field of Search ..... 442/195, 176; 428/397; 162/900, 902

(56) References Cited

U.S. PATENT DOCUMENTS

| | | | |
|---|---|---|---|
| 4,815,499 | | 3/1989 | Johnson . |
| 5,023,132 | * | 6/1991 | Stanley et al. ..... 428/234 |
| 5,429,686 | | 7/1995 | Chiu et al. . |
| 5,449,548 | | 9/1995 | Bowen, Jr. . |
| 5,651,394 | | 7/1997 | Marchand . |

FOREIGN PATENT DOCUMENTS

| | | |
|---|---|---|
| 4031608 | 4/1991 | (DE) . |
| 9211776 | 12/1992 | (DE) . |
| 4141139 | 6/1993 | (DE) . |
| 269070 | 6/1988 | (EP) . |
| 2487876 | 2/1982 | (FR) . |
| 2157328 | 10/1985 | (GB) . |

* cited by examiner

*Primary Examiner*—Elizabeth M. Cole
*Assistant Examiner*—Ula C. Ruddock
(74) *Attorney, Agent, or Firm*—Greenblum & Bernstein, P.L.C.

(57) ABSTRACT

Wire screening fabric for a machine for the production and/or finishing of a pulp web, such as a paper, cardboard, or tissue web, comprising at least one layer each of lengthwise fibers, oriented in the direction of travel, and crosswise fibers, running at a transverse angle thereto, woven together. An improvement of the adhesion of the pulp web on the wire-screening fabric is accomplished in that at least some of the crosswise fibers have a roughly drop-shaped or substantially three-sided, acute-angled cross-section, whereby the pointed end is oriented roughly in the direction of travel of the wire-screening fabric.

13 Claims, 1 Drawing Sheet

WIRE-SCREENING FABRIC, METHODS OF USING THE SAME, AND PAPERMAKING MACHINES COMPRISING SUCH FABRICS

CROSS-REFERENCE TO RELATED APPLICATIONS

The present application claims priority under 35 U.S.C. §119 of German Patent Application No. 198 17 050.5, filed on Apr. 17, 1998, the disclosure of which is expressly incorporated by reference herein in its entirety.

BACKGROUND OF THE INVENTION

1. Field of the Invention

The invention concerns a wire-screening fabric for a machine for the production and/or finishing of a cellulosic or pulp web, in particular a paper, cardboard, or tissue web comprising at least one layer of lengthwise fibers oriented in the direction of travel of the wire-screening fabric, and crosswise fibers running at a right angle thereto, woven together.

2. Discussion of Background Information

Such wire-screening fabrics are known, for example, from DE-OS 41 41 139, which is hereby incorporated by reference herein in its entirety. In addition to good stability, there is also a high water vapor permeability, so that the water vapor can be discharged through the wire. Moreover, the wire-screening fabric is designed largely closed to mark the pulp web as little as possible. In the aforementioned published application, this is accomplished in that the fibers have a trapezoidal cross-section, whereby the parallel sides run parallel to the direction of travel. However, the adhesion of the pulp web on the wire-screening fabric of the above-cited document is in need of improvement.

SUMMARY OF THE INVENTION

In wire screening fabrics in accordance with the invention, at least some of the crosswise fibers have a generally drop-shaped or substantially three-sided, acute-angled cross-section, whereby a pointed (or narrower) end is oriented roughly in the direction of travel of the wire-screening fabric. A mixture of crosswise fibers having either of such cross-sections may be employed.

The flow of air along the crosswise fibers as a result of the travel of the screen generates a vacuum downstream (with respect to the relative travel of air and the screen) from the crosswise fibers, because of the special shape of the cross-section, which improves the adhesion of the pulp web on the wire-screening fabric. This can be further improved in that the angle between the bisector of the pointed end of the respective cross-section and the surface of the wire-screening fabric contacted by the pulp web is between about 2° and about 70°, preferably between 5° and 40°. An increased portion of the air flow divided by the pointed end of the crosswise fiber is diverted away from the surface contacted by the pulp web, which increases the vacuum downstream from the crosswise fiber. This effect of the formation of a vacuum is also very pronounced when the side of the crosswise fiber facing the pulp web runs roughly parallel to the pulp web or is angled relative thereto such that the distance between the two increases opposite the direction of travel of the wire-screening fabric. Moreover, advantageous aspects of the screen, such as good water vapor the stability, and closed design are affected little thereby.

To ensure an adequate adhesion, it is sufficient in some embodiments that substantially only the crosswise fibers in the region of the surface of the wire-screening fabric contacted by the pulp web have a drop-shaped or substantially three-sided, acute-angled cross-section. In this case, the crosswise fibers in the region of the surface of the wire-screening fabric not contacted by the pulp web have a flat cross-section and are preferably oriented roughly in the direction of travel. In instances where a strong adhesion is desired, for example, with heavy papers, all crosswise fibers in accordance with the invention should have either a roughly drop-shaped or substantially three-sided, acute-angle cross-section.

The lengthwise fibers should always be flat or round, which reinforces the stability and has little influence on the flow relationships on the crosswise fibers. A mixture of lengthwise fibers having a flat or round cross-section can be employed. The wire-screening fabric is particularly well suited for use in a former, in a pressing section, or in a drying section of a paper machine.

A relatively simple way in which the fibers used in the invention, having the cross-sections according to the invention, may be produced comprises guiding fibers through the molding gap of two rolls, whereby at least one roll has a groove running in the circumferential direction to form the cross-sectional profile of the crosswise fibers. Moreover, it is possible to obtain this shape already during initial fiber formation, such as casting (extrusion) of the crosswise fibers by means of an appropriate nozzle (die).

In certain aspects the invention provides a wire-screening fabric for a machine for the production or finishing of a cellulosic web, the machine comprising a side for contacting the cellulosic web comprising at least one layer of lengthwise fibers oriented in a direction of travel of the wire screening fabric, and crosswise fibers generally transverse thereto, the fibers being woven together. At least some of the crosswise fibers comprise fibers having a cross sectional shape comprising a wide end and a narrow end, the shape selected from a shape which is substantially drop-shaped; and a shape which is substantially three-sided, and acute-angled. The narrow end of the cross sectional shape is oriented generally in the direction of travel of the wire-screening fabric.

In certain embodiments, the crosswise fibers are oriented at a right angle to the lengthwise fibers.

In certain embodiments, the narrow end of the cross-sectional shape of the crosswise fibers comprises a bisector, and the angle between the bisector of the narrow end and of the side of the wire-screening fabric for contacting the cellulosic web is between about 2° and about 70°. In certain embodiments, the angle is between about 5° and about 40°.

The crosswise fibers may comprise a side facing the side of the wire-screening fabric for contacting the cellulosic web, wherein the side is generally parallel to the side of the wire-screening fabric for contacting the cellulosic web or is angled relative thereto such that the distance between the side of the crosswise fiber and the side of the wire screening fabric increases opposite the direction of travel of the wire-screening fabric.

The wire-screening fabric may comprise a region contacted by a cellulosic web, and having crosswise fibers therein, and a region not contacted by a cellulosic web having crosswise fibers disposed therein, wherein substantially only the crosswise fibers in the region of the wire-screening fabric contacted by the cellulosic web have the above cross-sectional shape.

The crosswise fibers in the region of the wire-screening fabric not contacted by a cellulosic web may have a flat cross-sectional shape having a major axis, the major axis being oriented generally in the direction of travel of the wire screening fabric.

Substantially all of the crosswise fibers may have Such cross-sectional shapes. Of such shapes, substantially all may be either substantially drop-shaped substantially three-sided and acute-angled, or the fibers may be made up of a mixture of such fibers.

The lengthwise fibers may comprise fibers having cross sectional shape selected from flat or round, and substantially all lengthwise fibers may have a flat cross sectional shape, or have a round cross sectional shape, or the lengthwise fibers may be made up of a mixture of such fibers.

Such wire-screening fabrics may be employed in paper machines, such as in the former, press section or drying section.

In other aspects, the invention relates to a combination, comprising a cellulosic web and a wire-screening fabric for a machine for the production and/or finishing of a cellulosic web. The wire-screening fabric comprises a side contacting the cellulosic web and at least one layer of lengthwise fibers oriented in a direction of travel of the wire screening fabric, and crosswise fibers generally transverse thereto, the fibers being woven together. At least some of the crosswise fibers comprise fibers having a cross sectional shape comprising a wide end and a narrow end, the shape being selected from a shape which is substantially drop-shaped; and a shape which is substantially three-sided, acute-angled. The narrow end of the cross sectional shape is oriented generally in the direction of travel of the wire-screening fabric.

In such combinations the crosswise fibers may be oriented at a right angle to the lengthwise fibers.

In such combinations, the narrow end of the cross-sectional shape of the crosswise fibers may comprise a bisector, and the wire-screening fabric comprises a side which is contacted by the cellulosic web, and the angle between the bisector of the narrow end and of the side of the wire-screening fabric contacted by the cellulosic web is between about 2° and about 70°, preferably between about 5° and about 40°.

In some combinations, the crosswise fibers comprise a side facing the surface of the wire-screening fabric contacted by the cellulosic web, and this side is generally parallel to the surface of the wire-screening fabric contacted by the cellulosic web or is angled relative thereto such that the distance between the side of the crosswise fiber and the side of the wire screening fabric increases in the direction opposite the direction of travel of the wire-screening fabric.

The wire-screening fabric may comprise a region contacted by a cellulosic web, having crosswise fibers therein; and a region not contacted by a cellulosic web having crosswise fibers disposed therein, and substantially only the crosswise fibers in the region of the surface of the wire-screening fabric contacted by the cellulosic web have Such cross-sectional shape.

The crosswise fibers in the region of the wire-screening fabric not contacted by the cellulosic web have a flat cross-sectional shape may have a major axis, the major axis being oriented generally in the direction of travel of the wire screening fabric.

Substantially all of said crosswise fibers may have a cross-sectional shape selected from a shape which is substantially drop-shaped; and a shape which is a substantially three-sided, acute-angled shape.

In such combinations the crosswise fibers may comprise fibers having a cross-sectional shape which is substantially drop-shaped, or the crosswise fibers may comprise fibers having a cross-sectional shape which is substantially three-sided and acute-angled, or the crosswise fibers may be made up of mixtures of fibers having such cross sections. The lengthwise fibers comprise fibers having a cross sectional shape selected from flat or round, or may be made of a mixture of fibers having such cross-sectional shapes.

In such combinations, the cellulosic web may comprise a paper web, a cardboard web, or a tissue web.

In method aspects, the invention relates to methods of producing or finishing a cellulosic web as defined herein comprising contacting the cellulosic web with a wire-screening fabric, the wire-screening fabric comprising a side contacting the cellulosic web and comprising at least one layer of lengthwise fibers oriented in a direction of travel of the wire screening fabric, and crosswise fibers generally transverse thereto, the fibers being woven together, at least some of the crosswise fibers comprising fibers having a cross sectional shape comprising a wide end and a narrow end, the shape being selected from a shape which is substantially drop-shaped; and a shape which is substantially three-sided, acute-angled;

wherein the narrow end of the cross sectional shape is oriented generally in the direction of travel of the wire-screening fabric.

In such methods, the crosswise fibers may be oriented at a right angle to the lengthwise fibers.

The narrow end of the cross-sectional shape of the crosswise fibers may comprise a bisector and the wire-screening fabric may comprise a side which is contacted by the cellulosic web, and the angle between the bisector of the narrow end and of the side of the wire-screening fabric contacted by the cellulosic web may be between about 2° and about 70°, preferably between about 5° and about 40°.

The crosswise fibers in such methods may comprise a side facing the surface of the wire-screening fabric contacted by the cellulosic web, and this side may be generally parallel to the surface of the wire-screening fabric contacted by the cellulosic web or it may be angled relative thereto such that the distance between the side of the crosswise fiber and the side of the wire screening fabric increases opposite the direction of travel of the wire-screening fabric.

The screening fabric in such methods may comprise a region contacted by a cellulosic web, the region having crosswise fibers therein, and a region not contacted by a cellulosic web having crosswise fibers disposed therein, where substantially only the crosswise fibers in the region of the surface of the wire-screening fabric contacted by the cellulosic web have such cross-sectional shape. The crosswise fibers in the region of the wire-screening fabric not contacted by the cellulosic web may have a flat cross-sectional shape having a major axis, oriented generally in the direction of travel of the wire screening fabric.

In such methods, substantially all of the crosswise fibers may have a cross-sectional shape selected from a shape which is substantially drop-shaped; and a shape which is a substantially three-sided, acute-angled shape. The crosswise fibers may be made up of a mixture of fibers having such shapes. The lengthwise fibers comprise fibers having cross sectional shape selected from flat or round, or are made of a mixture of fibers having such a shape.

In Such methods, the cellulosic web may comprise a paper web, a cardboard web or a tissue web.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
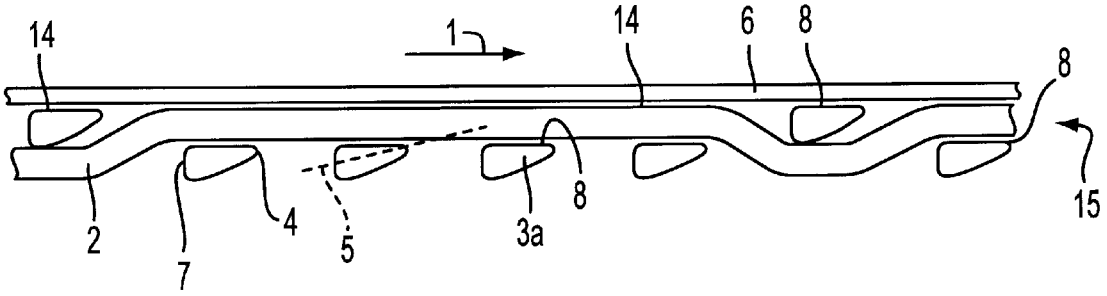
FIG. 1 is a schematic cross-sectional view of a single-layer wire-screening fabric in accordance with the invention.
Figure 2:
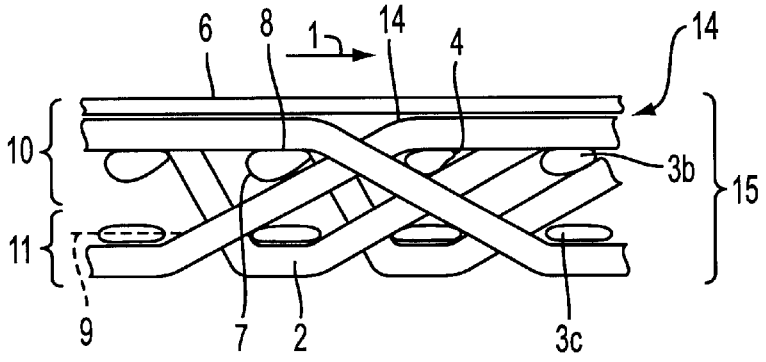
FIG. 2 is a schematic cross-sectional view of a two-layer wire-screening fabric in accordance with the invention.

In both the embodiments of FIG. 1 and of FIG. 2, the wire-screening fabric designated generally as 15 consists of lengthwise fibers 2 oriented in the direction of travel 1 and crosswise fibers 3*a* and/or 3*b,* and 3*c* running at a right angle thereto woven together. In the exemplary embodiment of FIG. 1, one layer each of lengthwise fibers 2 and crosswise fibers 3*a* , 3*b* and 3*c* is woven together; in the exemplary embodiment of FIG. 2, however, there are two layers of each. The wire screening fabric 15 comprises a side 14 for contacting a cellulosic web 6. The cross-wise fibers 3*a,* 3*c* and 3*b* can be at right angles to the lengthwise fibers, or generally transverse to the lengthwise fibers. As used herein, the term "transverse" includes right angles, as well angles less than or greater than about 90°.

In each exemplary embodiment of FIGS. 1 and 2 at least some of the crosswise fibers 3*a* or 3*b* have a generally drop-shaped cross-sectional shape 3*a* or substantially three-sided, acute-angled cross-section 3*b.* In such embodiments, the cross-sectional shape of such fibers includes a first or relatively wide end 7 and a second or relatively narrow end (which may be pointed) 4. The narrow end 4 is oriented roughly in the direction of travel 1 of the wire-screening fabric. Additionally, the angle between the bisector 5 of the pointed end 4 of the respective cross-section and the surface of the wire-screening fabric contacted by the pulp web 6 is between about 2° and about 70°, preferably between about 5° and about 40°. Moreover, the side 8 of the crosswise fibers 3 facing the pulp web 6 runs roughly parallel to the pulp web 6. Thus, the result is that the air is substantially diverted away from the pulp web 6 due to the travel of the wire-screening fabric. As a result, a vacuum which improves the adhesion of the pulp web 6 on the wire-screening fabric is created downstream from the crosswise fibers 3*a* and/or 3*b*. The lengthwise fibers 2 are illustrated as having a round cross-section in both cases. However, the lengthwise fibers may have a generally round cross section, or a substantially flat cross section similar to the flat cross section of crosswise fibers 3*e*.

In the embodiment of FIG. 2, substantially only the crosswise fibers 3*b* in the region 10 of the of the wire-screening fabric contacted by the pulp web 6 have a drop-shaped or substantially three-sided, acute-angled cross-section. The other crosswise fibers 3*c* in the region 11 of the of the screening fabric not contacted by the cellulosic web have a flat cross-section oriented in the direction of travel 1. The cross-sectional shape of Fibers 3*c* has a major axis 9, oriented generally in the direction of travel of the wire screening fabric.

The cross-sectional shape of crosswise fibers 3*a,* 3*b* and 3*c* may be formed by guiding the fibers through the molding gap of two rolls, whereby at least one roll has a corresponding groove (a groove corresponding to the desired cross-sectional shape) running in a circumferential direction. This groove may have a variable profile along the circumference of the roll, which accordingly affects the development of the cross-sectional shape of the crosswise fibers 3*a,* 3*b* and 3*c*.

Whereas the crosswise fibers 3*a* in FIG. 1 have a substantially three-sided, acute-angled cross-section and may have rounded corners, a roughly drop-shaped cross-section of the crosswise fibers 3*c* is depicted in FIG. 2.

Moreover, it will be appreciated that the wire-screening fabric can also have more than two layers of lengthwise fibers 2 and crosswise fibers 3.

It will be readily understood by those of ordinary skill in the art that the term "cellulosic web" includes any non-woven webs of cellulosic materials, such as paper, cardboard, tissue or the like.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A wire-screening fabric for a machine for the production or finishing of a cellulosic web, comprising:

a side for contacting said cellulosic web comprising at least one layer of a lengthwise fibers oriented in a direction of travel of the wire screening fabric, and crosswise fibers generally transverse thereto, said fibers being woven together, at least some of said crosswise fibers comprising fibers having a cross sectional shape comprising a wide end and a narrow end, said shape selected from at least one of a shape which is substantially drop-shaped and a shape which is substantially three-sided, and acute-angled at the narrow end;

wherein the narrow end of said cross sectional shape is arranged as a leading portion oriented generally in the direction of travel of the wire-screening fabric.

2. The wire-screening fabric of claim 1, wherein said crosswise fibers are oriented at a right angle to said lengthwise fibers.

3. The wire-screening fabric of claim 1, wherein the narrow end of the cross-sectional shape of said crosswise fibers comprises a bisector, and wherein the angle between the bisector of the narrow end and of the side of the wire-screening fabric for contacting the cellulosic web is between about 2° and about 70°.

4. The wire-screening fabric of claim 3, wherein said angle is between about 5° and about 40°.

5. The wire-screening fabric of claim 1, wherein the crosswise fibers comprises a side facing the side of the wire-screening fabric for contacting the cellulosic web, and said side is generally parallel to the side of the wire-screening fabric for contacting the cellulosic web or is angled relative thereto such that the distance between said side of said crosswise fiber and said side of the wire screening fabric increases opposite the direction of travel of the wire-screening fabric.

6. The wire-screening fabric of claim 1, wherein said screening fabric comprises a region contacted by a cellulosic web, said region having, crosswise fibers therein, and a region not contacted by a cellulosic web having crosswise fibers disposed therein, and substantially only the crosswise fibers in the region of the wire-screening fabric contacted by the cellulosic web have said cross-sectional shape.

7. The wire-screening fabric of claim 6, wherein said crosswise fibers in the region of the wire-screening fabric not contacted by a cellulosic web have a flat cross-sectional shape having a major axis, the major axis being oriented generally in the direction of travel of the wire screening fabric.

8. The wire-screening fabric of claim 1, wherein substantially all of said crosswise fibers have said cross-sectional shape selected from a shape which is substantially drop-shaped; and a shape which is a substantially three-sided, acute-angled shape.

9. The wire screening fabric of claim 1, wherein said crosswise fibers comprise fibers having a cross-sectional shape which is substantially drop-shaped.

10. The wire screening fabric of claim 1, wherein said crosswise fibers comprise fibers having a cross-sectional shape which is substantially three-sided and acute-angled.

11. The wire-screening fabric of claim 1, wherein said lengthwise fibers comprise fibers having a cross sectional shape selected from flat or round.

12. The wire-screening fabric of claim 11, wherein said lengthwise fibers comprise fibers having a flat cross sectional shape.

13. The wire-screening fabric of claim 11, wherein said lengthwise fibers comprise fibers having a round cross sectional shape.

* * * * *